US009835378B2

(12) United States Patent
Rademacher

(10) Patent No.: US 9,835,378 B2
(45) Date of Patent: Dec. 5, 2017

(54) APPLICATION SYSTEM FOR APPLYING A COATING AGENT

(71) Applicant: Dürr Systems GmbH, Bietigheim-Bissingen (DE)

(72) Inventor: Lothar Rademacher, Bietigheim-Bissingen (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 0 days.

(21) Appl. No.: 15/035,021

(22) PCT Filed: Nov. 3, 2014

(86) PCT No.: PCT/EP2014/002939
§ 371 (c)(1),
(2) Date: May 6, 2016

(87) PCT Pub. No.: WO2015/067357
PCT Pub. Date: May 14, 2015

(65) Prior Publication Data

US 2016/0290724 A1 Oct. 6, 2016

(30) Foreign Application Priority Data

Nov. 6, 2013 (DE) ..... 10 2013 018 554

(51) Int. Cl.
*B05C 5/00* (2006.01)
*F28C 3/02* (2006.01)
(Continued)

(52) U.S. Cl.
CPC ..... *F28C 3/02* (2013.01); *B05B 9/002* (2013.01); *B05B 13/0431* (2013.01);
(Continued)

(58) Field of Classification Search
CPC ..... B05C 5/001; B05C 11/1042; F28C 3/02; B05B 9/002; B05B 13/0431; F28F 5/00;
(Continued)

(56) References Cited

U.S. PATENT DOCUMENTS 4,644,140 A * 2/1987 Hillinger ..... B05B 1/24 219/421
4,890,573 A 1/1990 Zaber
(Continued)

FOREIGN PATENT DOCUMENTS

DE 69736098 T2 10/2006
DE 102008000451 A1 9/2009
DE 102010041706 A1 4/2012

OTHER PUBLICATIONS

International Search Report and Written Opinion for PCT/EP2014/002933 dated Feb. 6, 2015 (with English translation; 13 pages).

*Primary Examiner* — Laura Edwards
(74) *Attorney, Agent, or Firm* — Bejin Bieneman PLC

(57) ABSTRACT

An application system for applying a coating agent onto a component, in particular for applying a sealant onto a motor vehicle body part, includes a material supply for providing the coating agent, a temperature control device for controlling the temperature of the coating agent, an applicator for applying the coating agent, and a coating agent line between the material supply and the applicator. The temperature control device controls the temperature of the coating agent in the coating agent line downstream of the material supply.

17 Claims, 3 Drawing Sheets

Figure 1:
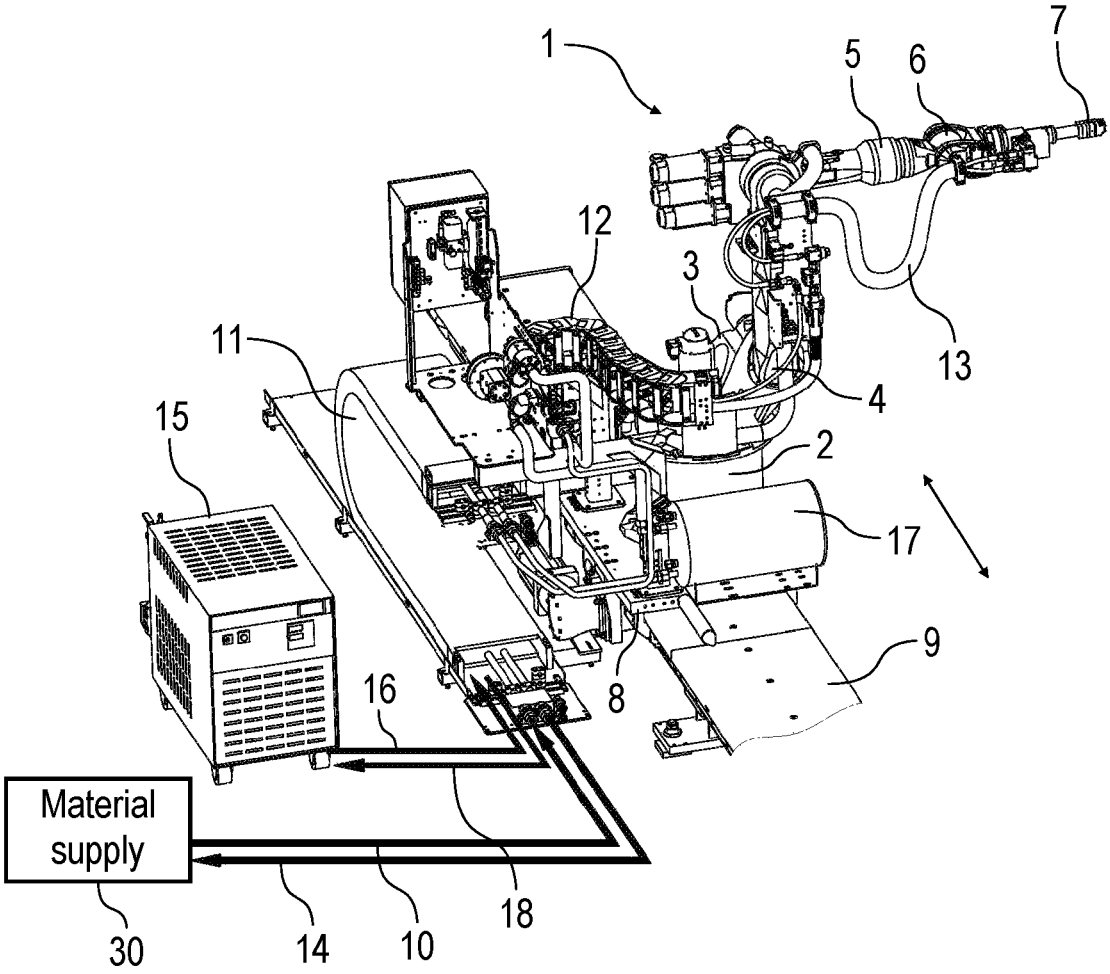

(51) Int. Cl.

| | |
|---|---|
| ***B05B 13/04*** | (2006.01) |
| ***B05C 11/10*** | (2006.01) |
| ***F28F 5/00*** | (2006.01) |
| ***F28D 7/00*** | (2006.01) |
| ***F28D 15/00*** | (2006.01) |
| ***B05B 9/00*** | (2006.01) |
| *F28D 21/00* | (2006.01) |

(52) U.S. Cl.
CPC ..... *B05C 5/001* (2013.01); *B05C 11/1042* (2013.01); *F28D 7/0016* (2013.01); *F28D 15/00* (2013.01); *F28F 5/00* (2013.01); *F28D 2021/0077* (2013.01)

(58) Field of Classification Search
CPC . F28D 7/0016; F28D 15/00; F28D 2021/0077
USPC ..... 118/302, 323, 58, 69; 901/43; 165/104.19, 104.32, 104.34; 239/128, 239/135, 139
See application file for complete search history.

(56) References Cited

U.S. PATENT DOCUMENTS

| | | | | |
|---|---|---|---|---|
| 4,932,353 | A | 6/1990 | Kawata et al. | |
| 5,363,907 | A | 11/1994 | Dunning et al. | |
| 7,322,188 | B2 * | 1/2008 | Cline ..... | F16K 49/00 239/135 |
| 2006/0289560 | A1 | 12/2006 | Bourget | |
| 2012/0125016 | A1 | 5/2012 | Cline | |

* cited by examiner

APPLICATION SYSTEM FOR APPLYING A COATING AGENT

CROSS-REFERENCE TO RELATED APPLICATIONS

This application is a national stage of, and claims priority to, Patent Cooperation Treaty Application No. PCT/EP2014/002939, filed on Nov. 3, 2014, which claims priority to German Application No. DE 10 2013 018 554.8 filed on Nov. 6, 2013, each of which applications are hereby incorporated herein by reference in their entireties.

BACKGROUND

The disclosure relates to an application system for applying a coating agent to a component, in particular for applying a sealant to a motor vehicle bodywork component.

For the sealing of motor vehicle bodywork components, PVC plastisols (PVC: polyvinyl chloride) are normally used. The application of these PVC plastisols is carried out with an applicator, with which different spraying techniques can be used.

In order to achieve a good coating quality, it is important that the material temperature is as constant as possible. For this purpose, in the background art, tempering apparatuses are used which control the material temperature of the PVC plastisols to a pre-determined target value which for most PVC plastisols is below +30° C., so that the PVC plastisols to be applied must typically be cooled. It should be mentioned here that, following their tempering, the tempered PVC plastisols must also pass through a coating agent line up to the relevant applicator, so that, for various reasons, the temperature of the PVC plastisols at the applicator can deviate from the pre-determined target value.

First, the ambient temperature of the coating agent line deviates more or less strongly from the pre-determined target value, which leads to a corresponding heating or cooling of the coating agent in the coating agent line. Thus, in summer, the ambient temperatures can be, for example, +40° C., which leads to corresponding heating of the coating agent in the coating agent line. Therefore, the actual temperature of the applied coating agent varies depending on the respective ambient temperature, which may relate to, e.g., the difference between day and night and also to the difference between summer and winter.

Second, in known application systems, the material flow is usually not continuous. Thus, for example, the coating agent might stand still in the coating agent line between the coating of two successive motor vehicle bodywork components, and then, in such circumstances, the standing coating agent may relatively quickly reach the ambient temperature.

In order to prevent such a temperature change within the coating agent line due to the ambient temperature deviating from the target temperature, it is known from the prior art to isolate the coating agent line thermally, although this solves the problem only partially.

Reference is also made, with regard to the prior art, to DE 10 2010 041 706 A1 and DE 10 2008 000 451 A1 and DE 697 36 098 T2. These publications do not, however, relate do the field of coating technology, but describe paper processing systems.

SUMMARY

According to this disclosure, a tempering apparatus tempers the coating agent at least downstream of the material supply and, i.e., not only at the entry to the coating agent line.

First, in accordance with the prior art, the disclosure includes a material supply which provides the coating agent to be applied (e.g. a sealant). In some embodiments of the disclosure, the application system serves to apply a sealant (e.g. PVC plastisols) to a bodywork component (e.g. a motor vehicle bodywork component). However, with regard to the coating agent to be applied, the disclosure is not restricted to sealants, but can also be utilized with other coating agents, for example, paints, adhesives, preservative agents (e.g. preservative wax) or insulating materials.

Furthermore, in accordance with the prior art, the disclosure includes an applicator in order to apply the coating agent. In an exemplary embodiment of the disclosure, the applicator is a nozzle applicator as sold by the applicant under the product name "EcoGun Sealing 3D". However, the disclosure is not restricted to this applicator but can also be realized with other types of applicators, such as, by way of non-limiting examples, rotary atomisers (e.g. bell atomisers, disk atomisers), ultrasonic atomisers, airmix devices and airless devices.

A coating agent line extends between the material supply and the applicator, supplying the applicator with the coating agent to be applied.

The tempering apparatus according to the disclosure is thermally coupled to and, thus, configured to temper (e.g. heat or cool) the coating agent in the coating agent line downstream of the material supply. In this way, the application system according to the disclosure differs from the known application system described in the introduction, wherein such a tempering apparatus tempers the coating agent only in the sphere of the material supply, and, thus, the temperature of the coating agent can still be influenced by the ambient temperature on flowing through the coating agent line.

In an exemplary embodiment of the disclosure, the coating agent line extends over at least a part of its length between the material supply and the applicator in an at least partially closed receiving space, which can be, for example, an energy chain or a protective sleeve. The tempering apparatus may conduct a heat carrier (e.g. air) through the receiving space of the coating agent line, in order to temper (e.g. heat or cool) the coating agent.

As used herein, it should be understood that the term "energy chain" may include embodiments such as a drag chain or cable chain and is not restricted to embodiments in which energy is actually transmitted. Rather, an energy chain herein may relate to a flexible line guide for receiving hoses (e.g. for compressed air, coating agents) and/or electrical lines (e.g. for power supply or for signal transmission), wherein the energy chain may have a fixed end and a displaceable end and can unroll along a guideway.

Furthermore, the feeding of the heat carrier (e.g. air) into the receiving space (e.g. energy chain, protective sleeve) of the coating agent line may generate excess pressure in the receiving space, such that the possible penetration of dirt (e.g. overspray) into the receiving space is prevented or at least hindered.

In an exemplary embodiment of the disclosure, the tempering apparatus comprises a heat carrier line through which, during operation, a liquid or gaseous heat carrier (e.g. air, water) is conducted in order to temper the coating agent.

In the case of the exemplary embodiment described above with a receiving space (e.g. energy chain, protective sleeve) for the coating agent line, the heat carrier line can extend, at least along part of its length, through the receiving space. Herein, bores can be arranged in the wall of the heat carrier line, so that the heat carrier flowing through the heat carrier line emerges outwardly through the bores into the receiving space for the coating agent line, in order to temper the coating agent.

The bores in the heat carrier line may be evenly distributed over the length of the heat carrier line, at least within the receiving space (e.g. energy chain, protective sleeve) of the coating agent line, in order to temper the coating agent line evenly over its length at least within the receiving space. For example, the bores can be arranged in the heat carrier line equidistantly in the axial direction.

Furthermore, according to this disclosure, the coating agent line, at least over part of its length, may adjoin the heat carrier line in order to achieve a good thermal contact between the coating agent line and the heat carrier line. For this purpose, the heat carrier line surrounds the coating agent line externally, e.g. helically. However, it is also possible in principle for the coating agent line to surround the heat carrier line externally, although this is less common in practice.

Furthermore, according to this disclosure, the coating agent line may be double-walled, including an inner wall and an outer wall. In such an embodiment, the coating agent line therefore has two separate line cross-sections, specifically one line cross-section within the inner wall and one line cross-section between the inner wall and the outer wall of the coating agent line. The coating agent then flows in one line cross-section, whilst the heat carrier flows in the other line cross-section. In such an embodiment, the coating agent flows within the inner wall, while the heat carrier flows between the inner wall and the outer wall.

With a double-walled coating agent line of this type, coating agents and heat carriers can flow in the same direction. It is alternatively also possible however that the coating agent and the heat carrier flow in opposing directions.

As used herein, the term "tempering" should be understood broadly, including, e.g., any controlled heat transfer, i.e. both cooling and heating of the coating agent.

In a variant of the disclosure, the tempering apparatus has a cooling system for cooling the heat carrier, wherein the cooling system can have, for example, a conventional cooling compressor.

Alternatively, the tempering apparatus may have a nozzle through which the gaseous heat carrier is fed, in particular, from a compressed air network of the application system, wherein the heat carrier is expanded and thereby becomes cooled.

In some embodiments, the tempering apparatus may include a Peltier element, which may extend in the form of an accompanying cooling system in the axial direction over at least one line portion of the coating agent line.

Furthermore, the tempering apparatus may have an electrically powered heating tube which is a component of the coating agent line, so that the coating agent can be heated while flowing through the heating tube.

In an exemplary embodiment of the disclosure, the application device is guided by a multi-axis application robot. Such application robots are per se known in the prior art and typically have serial robot kinematics with a proximal robot arm ("arm 1") and a distal robot arm ("arm 2"), wherein the applicator is mounted on the distal robot arm ("arm 2"), for example by means of a multi-axis robot hand axis. It is herein advantageous if the tempering apparatus tempers the coating agent at least up to the distal robot arm of the application robot, so that the remaining line length up to the applicator leads to only slight temperature changes.

In such an exemplary embodiment of the disclosure, the tempering apparatus may have a tempering device which supplies a tempered liquid heat carrier. The tempered liquid heat carrier (e.g. water) is then fed to a heat exchanger (e.g. helical pipe heat exchanger) which supplies a tempered gaseous heat carrier (e.g. air) on the output side for tempering the coating agent. The coating agent to be tempered is herein therefore tempered by the gaseous heat carrier (e.g. air) which itself is tempered via the heat exchanger by the liquid heat carrier (e.g. water).

The aforementioned application robot can be arranged on a carriage which is movable along a rail ("axis 7"). The rail herein may extend parallel adjacent to a processing line (e.g. paint line) on which the components to be coated are conveyed through the application system. The aforementioned heat exchanger is then not arranged stationary but, e.g., is mounted on the carriage to travel therewith. This brings the advantage that the maximum flow routes of the gaseous heat carrier can be kept relatively short, so that the gaseous heat carrier changes temperature only slightly during the tempering. This is important since, in contrast to a liquid heat carrier, a gaseous heat carrier has only a relatively small heat capacity and therefore changes temperature even after a relatively brief thermal contact with the coating agent.

In the variant of the disclosure described above with a movable carriage, at least two energy chains may be provided, specifically a first energy chain for supplying the displaceable carriage with the application robot and a second energy chain between the carriage and the applicator.

The first energy chain for supplying the displaceable carriage thus contains, e.g., the heat carrier line for the liquid heat carrier (e.g. water) and the coating agent line, wherein starting from the carriage with the heat exchanger, the gaseous heat carrier (e.g. air) is fed into the first energy chain in order to temper the coating agent line over this line portion.

The second energy chain between the displaceable carriage and the applicator thus contains a further line portion of the coating agent line, wherein starting from the carriage with the heat exchanger, the gaseous heat carrier (e.g. air) is fed into the second energy chain in order to temper the coating agent line also within the second energy chain.

Thus, the flow directions of the gaseous heat carrier may be opposed in the two energy chains. Thus, the gaseous heat carrier (e.g. air) may flow in the proximal robot arm ("arm 1") against the flow direction of the coating agent. In the distal robot arm ("arm 2"), however, the gaseous heat carrier may flow in the same direction as the coating agent.

In the description above, it should be understood that the heat carrier can be, for example, liquid or gaseous, wherein particularly air and water suggest themselves as heat carriers.

It should further be understood that, according to the disclosure, the tempering apparatus may affect the coating agent temperature over a particular line length, wherein this tempered line length of the coating agent line may be, e.g., at least 50 cm, 1 m, 2 m or 5 m long and may comprise, e.g., at least 10%, 20%, 50%, 70% or even 90% of the overall length of the coating agent line.

It should further be understood that the tempering apparatus may temper the coating agent line in at least the fifth, quarter or third of its overall length situated downstream, so that over the remaining line portion of the coating agent line, the smallest possible temperature changes can occur.

DRAWINGS

Figure 2:
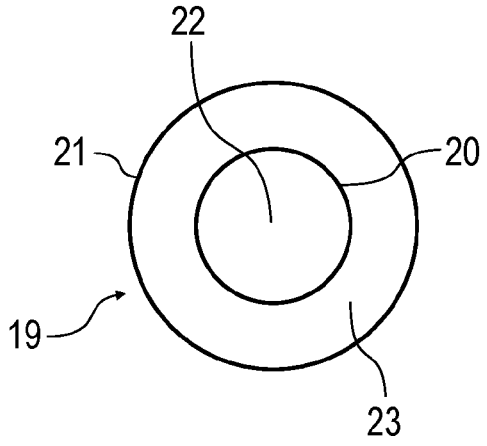
Figure 3:
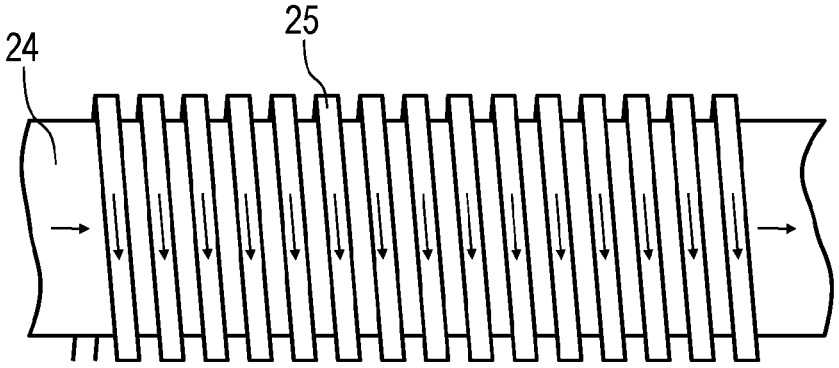
Figure 4:
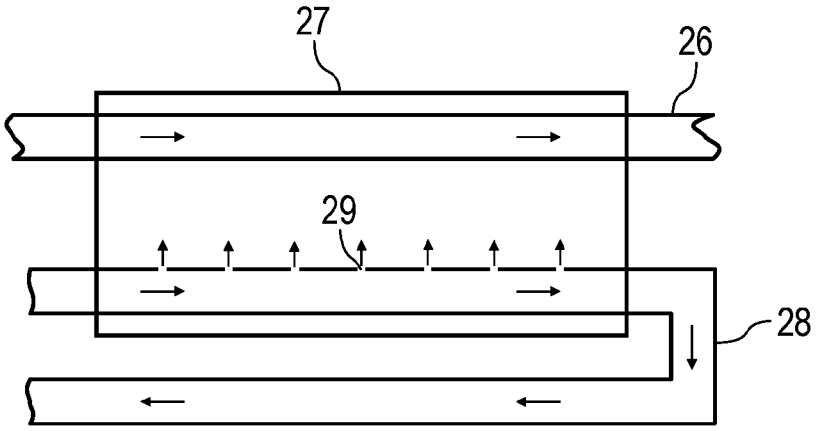
Figure 5:
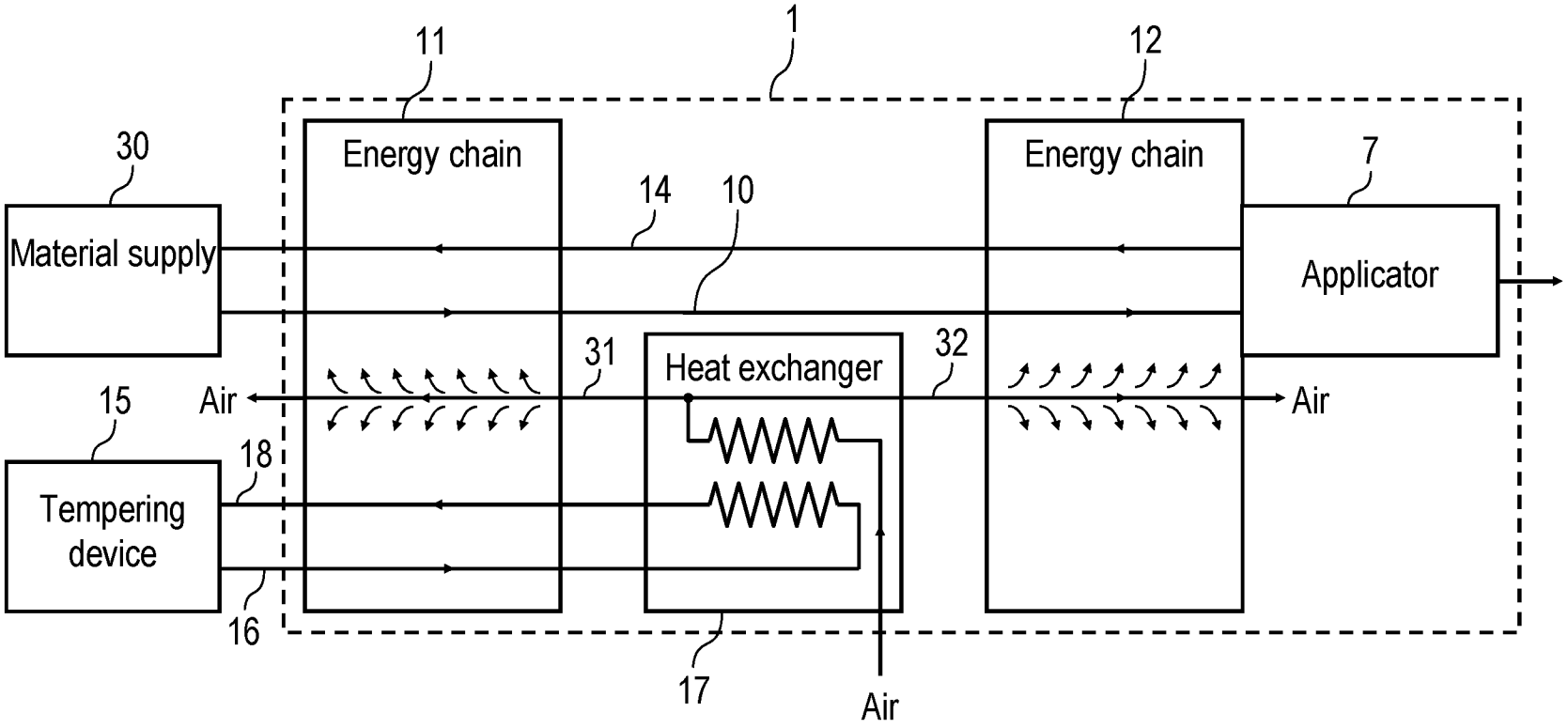

The disclosure is described below in greater detail together with the description of exemplary embodiments, making reference to the drawings, in which:

FIG. 1 shows a perspective view of an application system according to the disclosure for applying a sealant to motor vehicle bodywork components, FIG. 2 shows a cross-sectional view through a double-walled coating agent line, FIG. 3 shows a side view of a coating agent line having a helical winding with a heat carrier line, FIG. 4 shows a schematic representation of a receiving space (e.g. energy chain) for a coating agent line, wherein a gaseous heat carrier is fed into the receiving space, and FIG. 5 shows a schematic representation to illustrate an application system according to the disclosure with two energy chains and a heat-exchanger arranged therebetween.

DETAILED DESCRIPTION

FIG. 1 shows a perspective view of an application system according to the disclosure for applying sealant (e.g. PVC plastisols) to a motor vehicle bodywork component.

For this purpose, the application system has a multi-axis application robot 1 with a robot base 2, a rotatable robot part 3, a proximal robot arm 4 ("arm 1"), a distal robot arm 5 ("arm 2"), a robot hand axis 6 and an applicator 7. The applicator 7 may be, e.g., the "EcoGun Sealing 3D" which is sold by the applicant, although other applicator types are also usable in the context of the disclosure.

The robot base 2 of the application robot 1 is mounted on a carriage 8 wherein the carriage 8 is movable along a rail 9 in the direction of the arrow. The rail 9 is herein arranged laterally beside a conveyor line and extends parallel to the conveyor line, wherein the motor vehicle bodywork components to be processed are conveyed through the application system.

The supply of the sealant to be applied is carried out via a feed line 10 which extends through an energy chain 11, an energy chain 12 and a protective sleeve 13 to the applicator 7.

A return line 14 extends from the applicator 7 to a material supply 30, so that the feed line 10 together with the return line 12 enables material circulation from the material supply 30 to the applicator 7.

Furthermore, the application system has a tempering device 15 which provides tempered water which is conveyed via a feed line 16 to a heat exchanger 17 on the carriage 8. From the heat exchanger 17, a return line 18 extends back to the tempering device 15, enabling a material circulation of the tempered water between the tempering device 15 and the heat exchanger 17.

The heat exchanger 17 tempers, as the heat carrier, ambient air and the air is then blown both into the energy chain 11 and also into the energy chain 12 in order to temper the feed line 10 which extends there for the coating agent. Furthermore, the tempered air emerging from the heat exchanger 17 is also blown into the protective sleeve 13 in order also to temper the feed line 10 extending there for the sealant.

It should be mentioned herein that the two energy chains 11, 12 are configured largely closed, so that the inner temperature within the energy chains 11, 12 is essentially determined by the temperature of the air tempered by the heat exchanger 17 and blow in.

The heat exchanger 17 is arranged on the displaceable carriage 8 so that the spacing between the heat exchanger 17 and the air-tempered line portions of the feed line 10 for the coating agent is as small as possible. This is important since the heat capacity of air as a heat carrier is only relatively small, so that the tempering effect of the air used as a heat carrier is sufficiently large only over a relatively short distance.

In the exemplary embodiment shown, the feed line 10 for the coating agent is therefore tempered over almost its entire line length between the material supply 30 and the applicator 7, so that the sealant applied by the applicator 7 maintains the prescribed temperature regardless of the ambient temperature.

FIG. 2 shows a cross-section through a variant of a coating agent line 19 according to the disclosure with an inner wall 20 and an outer wall 21. Arranged within the inner wall 20 is a line cross-section 22 through which, during operation, the coating agent to be applied flows. Arranged between the inner wall 20 and the outer wall 21, however, is a line cross-section 23 through which, during operation, a liquid or gaseous heat carrier (e.g. air, water) flows in order to temper the coating agent in the inner line cross-section 22.

FIG. 3 shows a simplified side view of a coating agent line 24 according to the disclosure which is externally wound round helically by a heat carrier line 25 in order to temper the coating agent in the coating agent line 24.

Furthermore, FIG. 4 shows a schematic representation of a coating agent line 26 which extends over part of its line length through a receiving space 27 (e.g. energy chain, protective sleeve).

In addition, a heat carrier line 28 which has a plurality of equidistantly arranged bores 29 within the receiving space 27 also extends through the receiving space 27, through which bores a gaseous heat carrier (e.g. air) emerging through said bores into the receiving space 27 in order to temper the interior of the receiving space 27. Furthermore, due to the emerging air, an excess pressure is generated in the receiving space 27, by means of which contamination of the interior of the receiving space 27, for example, by overspray is largely prevented. The tempered air emerging through the bores 29 therefore generates a defined space climate in the receiving space 27 in order to temper the coating agent in the coating agent line 26.

FIG. 5 shows a schematic representation of the exemplary embodiment according to FIG. 1, so that, for the avoidance of repetition, reference is made to the above description, wherein the same reference signs are used for corresponding details.

From this schematic illustration, it is clear that tempered air is fed from the heat exchanger 17 via heat carrier lines 31, 32 into the energy chains 11, 12 in order to temper the feed line 10 which extends there for the coating agent. The heat carrier lines 31, 32 can each have bores within the energy chains 11, 12, from which the tempered air can emerge into the interior of the respective energy chain 11, 12 in order to temper the interior of the energy chains.

The disclosure is not restricted to the above-described pexemplary embodiments. Rather a plurality of variants and derivations is possible which also may make use of the disclosure.

The invention claimed is:

1. An application system for applying a coating agent to a component, comprising:

a material supply for providing the coating agent, an applicator for applying the coating agent to the component, a coating agent line extending between the material supply and the applicator, and a tempering apparatus thermally coupled to the coating agent line, wherein the tempering apparatus is configured to temper the coating agent in the coating agent line downstream of the material supply; the tempering apparatus comprises a tempering device which supplies a tempered liquid heat carrier, and the tempering apparatus comprises a heat exchanger which is connected on an input side to the tempering device and on an output side supplies a tempered gaseous heat carrier for tempering the coating agent;

the applicator is guided by a multi-axis application robot, and the application robot and the heat exchanger are arranged on a carriage which is configured to move along a rail, and a first energy chain upstream of the carriage, wherein the first energy chain supplies the heat exchanger on the carriage with the liquid heat carrier, and guides a line portion of the coating agent line, and feeds back the gaseous heat carrier from the heat exchanger in order to temper the line portion of the coating agent line in the first energy chain, and a second energy chain downstream of the movable carriage, wherein the second energy chain guides a line portion of the coating agent line between the carriage and the applicator, and feeds back the gaseous heat carrier from the heat exchanger in order to temper the line portion of the coating agent line in the second energy chain.

2. The application system according to claim 1, wherein, between the material supply and the applicator, the coating agent line extends at least in part into an at least partially closed receiving space, and the tempering apparatus is configured to conduct a fluid heat carrier through the receiving space to temper the coating agent.

3. The application system according to claim 1, wherein the tempering apparatus includes a heat carrier line, and the tempering apparatus is configured to conduct a fluid heat carrier through the heat carrier line to temper the coating agent.

4. The application system according to claim 3, wherein, between the material supply and the applicator, the coating agent line extends at least in part into an at least partially closed receiving space, the heat carrier line extends, at least in part, through a portion of the receiving space, and the heat carrier line includes one or more bores through a wall thereof, the heat carrier line configured to release the heat carrier flowing through the heat carrier line through the one or more bores into the receiving space for the coating agent line to temper the coating agent.

5. The application system according to claim 4, wherein the heat carrier emerges outwardly from the receiving space through openings in a wall of the receiving space.

6. The application system according to claim 4, wherein the heat carrier line has a plurality of bores through the wall thereof, the plurality of bores being evenly distributed over the part of the heat carrier line within the receiving space.

7. The application system according to claim 2, wherein the tempering apparatus includes a heat carrier line, and the coating agent line is at least in part adjacent to the heat carrier line.

8. The application system according to claim 7, wherein the heat carrier line surrounds the coating agent line.

9. The application system according to claim 8, wherein the heat carrier line surrounds the coating agent line helically.

10. The application system according to claim 7, wherein the coating agent line includes an inner wall and an outer wall, the coating agent line is configured to contain the coating agent flow within the inner wall, and the heat carrier line extends between the inner wall and the outer wall of the coating agent line.

11. The application system according to claim 1, wherein the tempering apparatus includes a nozzle in fluid communication with a heat carrier and configured to facilitate expansion of the heat carrier.

12. The application system according to claim 1, wherein the tempering apparatus comprises a Peltier element configured to cool the coating agent line.

13. The application system according to claim 1, wherein the tempering apparatus includes an electrically powered heating tube coupled to the coating agent line and configured to heat the coating agent flowing through the heating tube.

14. The application system according to claim 12, wherein the Peltier element extends over a length of at least 50 cm of the coating agent line.

15. The application system according to claim 1, wherein the applicator is guided by a multi-axis application robot, the application robot has a proximal robot arm and a distal robot arm, and the tempering apparatus tempers the coating agent at least up to the distal robot arm of the application robot.

16. The application system according to claim 1, wherein the tempering apparatus tempers the coating agent line over a line length of at least 50 cm.

17. The application system according to claim 1, wherein the tempering apparatus tempers the coating agent line over a line length of at least 20% of its overall length.

* * * * *